United States Patent [19]

Greenberg

[11] 4,310,157

[45] Jan. 12, 1982

[54] TENNIS RACKET

[75] Inventor: Louis E. Greenberg, Boulder, Colo.

[73] Assignee: AMF Incorporated, White Plains, N.Y.

[21] Appl. No.: 126,737

[22] Filed: Mar. 3, 1980

[51] Int. Cl.[3] ..... A63B 49/10

[52] U.S. Cl. ..... 273/73 C; 273/73 F; 273/DIG. 23

[58] Field of Search ..... 273/67 R, 73 R, 73 C, 273/73 D, 73 F, 73 G, 73 H

[56] References Cited

U.S. PATENT DOCUMENTS

| | | | |
|---|---|---|---|
| 3,515,386 | 6/1970 | Mason | 273/73 R |
| 3,690,658 | 9/1972 | Howe | 273/73 F X |
| 3,999,756 | 12/1976 | Head | 273/73 C |
| 4,165,071 | 8/1979 | Frolow | 273/73 C |
| 4,196,901 | 4/1980 | Durbin | 273/73 G |

FOREIGN PATENT DOCUMENTS

| | | | |
|---|---|---|---|
| 2752624 | 5/1979 | Fed. Rep. of Germany | 273/73 C |
| 2717 | of 1909 | United Kingdom | 273/73 C |

*Primary Examiner*—Richard J. Apley

*Attorney, Agent, or Firm*—George W. Price; Walter Lewis

[57] ABSTRACT

A short tennis racket having an oblong, oval shaped head.

1 Claim, 2 Drawing Figures

TENNIS RACKET

This invention relates to an improved tennis racket, and more particularly, to an improved oversized tennis racket.

There are currently on the market several oversized tennis rackets, U.S. Pat. No. 3,999,756 being one example thereof, and John G. Howe Ser. No. 64,318 filed 8/6/79 now U.S. Pat. No. 4,275,885 granted 6/30/81, and which is assigned to the same assignee as the instant invention being another example thereof. The first provides an increased ball hitting area by making the head of the racket longer and wider than in conventional rackets, and the second by making the head of the racket oversized in length but comparable to conventional rackets in width. Although the second provides advantages not present in the first, I have discovered that it can be further improved upon so as to improve its playability.

It is an object of this invention to improve the playability of oversize rackets, and in particular the playability of the type of oversize racket shown and described in copending Ser. No. 64,318 so as to retain all the advantages thereof but still obtain further improvements therein.

Briefly, in my invention the head of the racket has an oblong oval shape but the ratio of the head length to the overall length of the racket is increased in such a manner as to increase the playability thereof in a manner to be described hereinafter.

Figure 1:
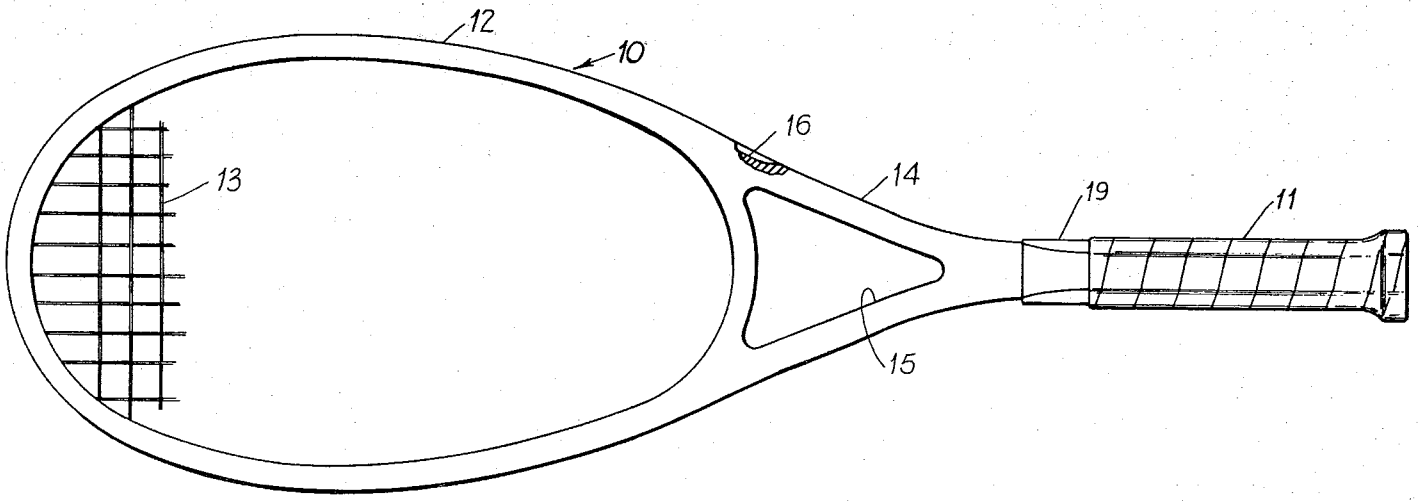
Figure 2:
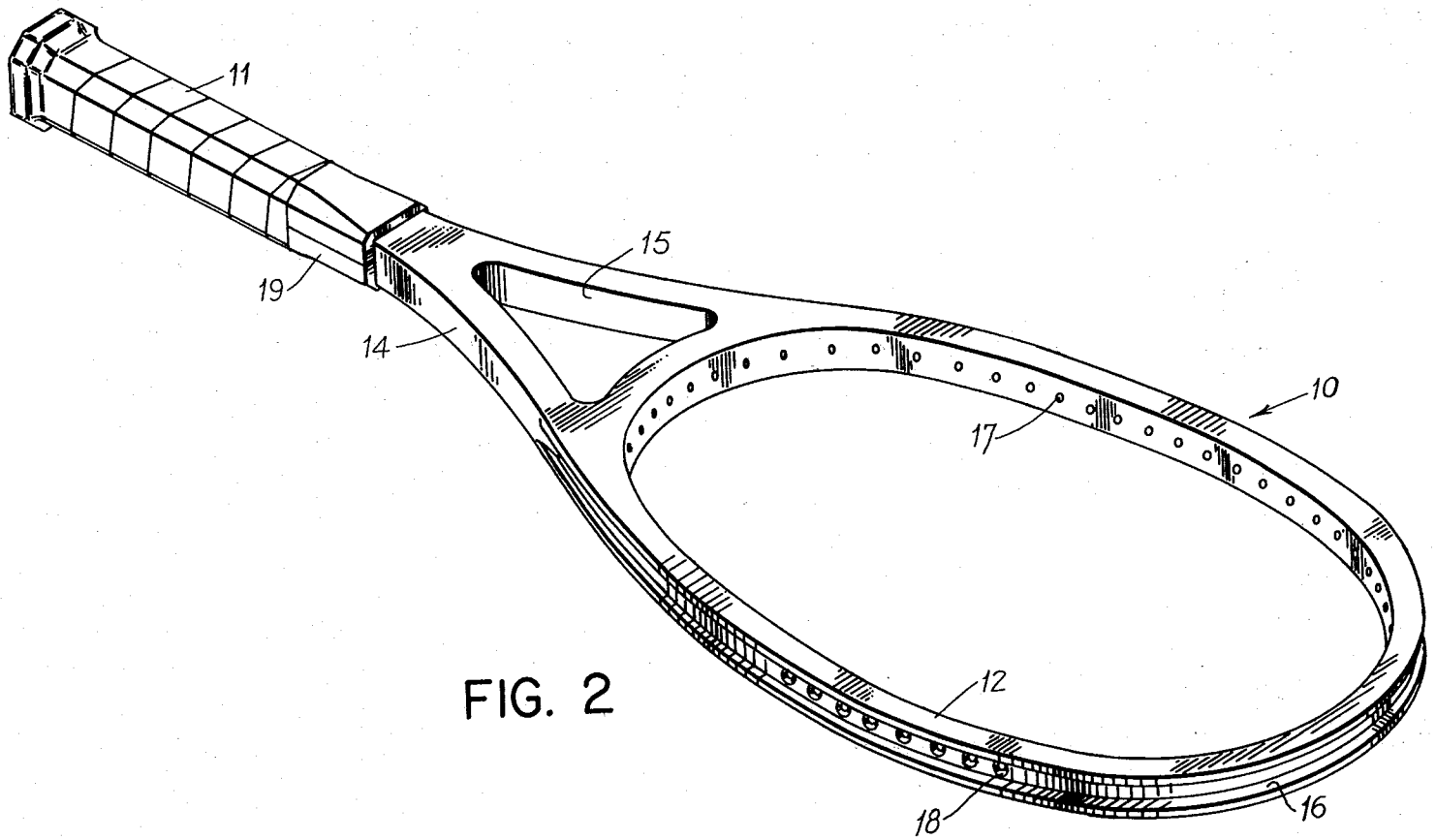

The invention will be best understood by considering the following description thereof taken in connection with the accompanying two sheets of drawing in which FIG. 1 comprises a face elevation view thereof; and FIG. 2 a perspective view thereof.

Opposite sides and edges of the racket are the same. That is to say, the racket is symmetrical. The racket is the same as that shown in Ser. No. 64,318 except for the differences to be noted hereinafter.

Briefly, the frame 10 has a hollow or tubular construction of light weight blended graphite-fiberglass composite. The butt or handle end of the frame is provided with a hand grip 11. The ball hitting head part of the frame 12 has an oblong oval shape. Stringing for the head is indicated schematically by crossed lines 13. The opposite ends of the racket are interconnected by an intermediate integral open throat portion 14 having a triangular shaped cutout 15. Thus the head, throat, and handle of the frame comprise a single piece unitary member.

The loop part 12 of the racket is provided with an outer circumferential groove 16 molded therein. Thus, the outer ends of the strings 13 are recessed in the groove 16 to protect them from scuffing. The loop part of the racket has string holes 17 for the strings 13 and the outer ends of the holes 17 can be provided with grommets 18 as illustrated in FIG. 2 so that the outer edges of the holes 17 do not cut the ends of the strings 13. The hand grip 11 comprises leather tape wrapped around two complementary end pieces 19 affixed to the lower butt end of the racket.

The loop 12 has the shape of an oblong oval. The ratio of the maximum string length to string width in a current form of the invention is 1.75;1, although this could be slightly more or less. Prior art conventional and oversized rackets have a ratio of much less than 1.75;1. The strung length is 14" which is slightly longer than the largest of oversized rackets currently on the market, but the strung width is 8" which is comparable to that of conventional rackets and much less than that of the largest of oversized rackets currently on the market.

The racket just described above is essentially the racket of Ser. No. 64,318. However, in the preferred form thereof of my invention the overall length of the racket is 25¾" although this could be in the range of 23 to 26". In other words, my invention provides a shortened oversize racket. In the particular given instance, since the string length of 14" has not been reduced, the handle has been shortened to provide a string length to overall length ratio of 14 to 25.75 or 0.544; while still retaining the ratio of string length to string width of 14 to 8 or 1.75 but this could be in the range of 1.6 to 2. Although in the particular example given the ratio of string length of overall length is 0.544 this could be in the range of 0.50 to 0.80. This, in combination with other considerations provides an oversize racket of increased playability.

For example, the racket is of light weight composite so that its total strung weight is 315 to 345 grams although this could be as low as 300 grams. What this means in terms of a shorter handle or overall length for the oversize racket is that there is a reduced static moment for the racket, which is the product of the weight of the racket multiplied by the distance of the player's hand from the center of gravity of the racket. The reduction is of the order of 20% and this same racket will also have a reduced moment of inertia which is the time in seconds it takes to make a given number, such as 25, oscillations about its center of gravity.

As compared to the prior art, the instant racket is unlike most prior rackets in several important respects. In the prior art most rackets are 26¼ to 29" in overall length and have a strung weight of from 345 to 400 grams. Also, their ratios of string length to overall racket length are well below 0.544 and their ratios of head length to head width are considerably less than 1.75. And, since most are longer and heavier they will have far larger static moments and their moments of inertia will be at least about 10% more.

Although in the particular example given the racket has a string length and width and overall length of 14, 8 and 25¾ inches respectively to give a ratio of string length to string width of 1.75 and a ratio of string length to overall length of 0.544, along with a particular weight, it will be appreciated that the gist of the invention resides in making the racket light weight with an oblong oval head with shorter handle or overall length as compared to those of the prior art. The oblong head will give the advantages of copending Ser. No. 64,318 and the light weight and the shortened handle or overall length, and in particular the latter, will improve the playability of the racket. By playability is meant a racket which makes it easier to learn and play the game without having the training, coordination, skills, strength, etc. possessed by a professional.

For example, heretofore oversize rackets have been too long and heavy to make it easier to play the game, and short light rackets suffered a power loss. However, in the invention with the trampoline effect of the oval shaped large string plane area the lost power is regained, and since the racket is shorter the ball is contacted closer to the hand so there is better hand-eye coordination. And, since the racket is lighter it allows the player to initiate his swing when the ball is closer, hence timing is improved. Lower inertia of the racket makes it easier to make racket face corrections for better stroke control, and a lighter shorter racket requires less conditioning and strength since it is less tiring on the player. Volleying is much improved since quick mobility of the racket due to its low inertia makes it easier to react quickly. Serving is also easier since the ball does not need to be thrown as high, hence it is hit closer to the eye, and the wind-up motion is easier due to lower inertia of the racket.

While there has been shown and described a particular form of the invention, it will be understood that this is exemplary only, and that the true spirit and scope thereof is to be measured by the appended claims.

I claim:

1. A tennis racket comprising a single piece unitary hollow tubular frame constructed from blended graphite-fiberglass composite, said frame comprising a loop portion and a handle portion interconnected by an integral open throat portion, a part of said throat portion comprising a continuation of said loop portion to make said loop portion an enclosed open loop, an outer circumferential stringing groove formed in said loop portion, stringing holes formed in said groove and throat portion part, tennis racket strings extending through said holes lengthwise and crosswise said enclosed open loop, all of said loop, handle and throat portions and said tennis strings being coplanar, said enclosed open loop having an oblong oval shape, said length-wise strings being about 14" long and said crosswise strings being about 8" long whereby the ratio of the length to the width of the inner strung area of said oblong oval shape is about 1.75 to 1, the strung weight of the racket being of the order of 300 to 345 grams, and the overall length of the racket being of the order of 23 to 26 inches.

* * * * *